US006101651A

United States Patent [19]

Tang

[11] Patent Number: 6,101,651

[45] Date of Patent: Aug. 15, 2000

[54] PILLOW CORE

[75] Inventor: Yee Keung Tang, Hong Kong, The Hong Kong Special Administrative Region of the People's Republic of China

[73] Assignee: Wing Hang (3Y) Industries Ltd., The Hong Kong Special Administrative Region of the People's Republic of China

[21] Appl. No.: 09/274,923

[22] Filed: Mar. 23, 1999

[51] Int. Cl.[7] ..... A47G 9/10; A47C 27/00

[52] U.S. Cl. ..... 5/642; 5/643; 5/719; 5/252; 5/255

[58] Field of Search ..... 5/642, 643, 645, 5/247, 252, 255, 719, 655.7; 267/117, 142, 143

[56] References Cited

U.S. PATENT DOCUMENTS

| | | | |
|---|---|---|---|
| 2,940,087 | 6/1960 | Kiefer | 5/642 |
| 2,979,739 | 4/1961 | Krakauer | 5/719 |
| 3,261,037 | 7/1966 | Cermak et al. | 5/719 X |
| 3,263,247 | 8/1966 | Knittel et al. | 5/719 X |
| 3,276,048 | 10/1966 | Beckman | 5/719 X |
| 3,815,887 | 6/1974 | Curtis et al. | 5/719 X |
| 5,632,473 | 5/1997 | Queiroz | 5/719 X |

FOREIGN PATENT DOCUMENTS

| | | | |
|---|---|---|---|
| 86200660 U | 8/1987 | China . | |
| 2050847 U | 1/1990 | China . | |
| 2109137 U | 7/1992 | China . | |
| 2153289 U | 1/1994 | China . | |
| 1148718 | 10/1956 | Germany | 5/719 |

OTHER PUBLICATIONS

Search Report from Patent Office of People's Republic of China issued in Short–Term Patent No. HK1009721 dated May 1999.

*Primary Examiner*—Michael F. Trettel
*Attorney, Agent, or Firm*—Banner & Witcoff, Ltd.

[57] ABSTRACT

A novel pillow core is made of plastic springs. A plurality of springs are connected together by a plastic link frame to form an actual pillow shape. The pillow core made of the plastic springs has strong supporting capacity, good elasticity and ventilation, and eliminates areas of heat concentration. It can easily be made into different sizes and can accommodate the neck portions of different users. In addition, it is easy to carry about and eliminate the necessity for cleaning and drying. Moreover, it saves raw materials such as feathers or silk cotton and the like, and shows excellent quality with reasonable prices.

17 Claims, 6 Drawing Sheets

PILLOW CORE

FIELD OF THE INVENTION

The invention relates to a pillow core.

BACKGROUND OF THE INVENTION

Conventional pillow cores have been made of materials such as silk cotton, feathers or the like. When the user rests his or her head on a pillow having such a core, the pillow tends to sink at the associated portion thereof because of the inadequate supporting capacity of its core. As a result, users may not feel well when their body turns over. Besides, a pillow made of such materials will become contaminated if frequently used, even if a pillow-towel or pillow case is used to cover it. A pillow may also acquire an offensive odor if stored for a long period of time. Moreover, it can be troublesome to wash and dry a pillow with silk cotton or feathers within it.

SUMMARY OF THE INVENTION

The object of the present invention is to provide a pillow core comprising plastic-made springs. The core has excellent supporting capacity and elasticity. Also, the core can be easily washed and dried.

The object of the invention is achieved by providing a pillow core comprising plastic-made link frames and plastic-made springs. The plastic link frames include cross-bars and a plurality of frame holes for receiving the plastic springs. The plastic link frame can connect a plurality of springs of different dimensions into a pillow core having the size of a conventional pillow. Springs within the pillow core may have different lengths so that they can conform to the curve of a user's neck.

In comparison with conventional pillow cores, the core of the present invention has an advantage in that it provides improved supporting capacity, elasticity and ventilation while eliminating areas of heat concentration. Also, the core of the present invention can easily be made into different sizes and have different curves in order to accommodate different necks. Moreover, the core is easy to carry. Further, the necessity for cleaning and drying the core is eliminated, and the natural resources which provide feathers and silk cotton are saved. The pillow of the present invention is attractive and inexpensive.

BRIEF DESCRIPTION OF THE DRAWINGS

The invention and its preferred embodiment will be hereinafter explained in detail with reference to the accompanying drawings.

DETAILED DESCRIPTION OF THE PREFERRED EMBODIMENTS

Figure 1A:
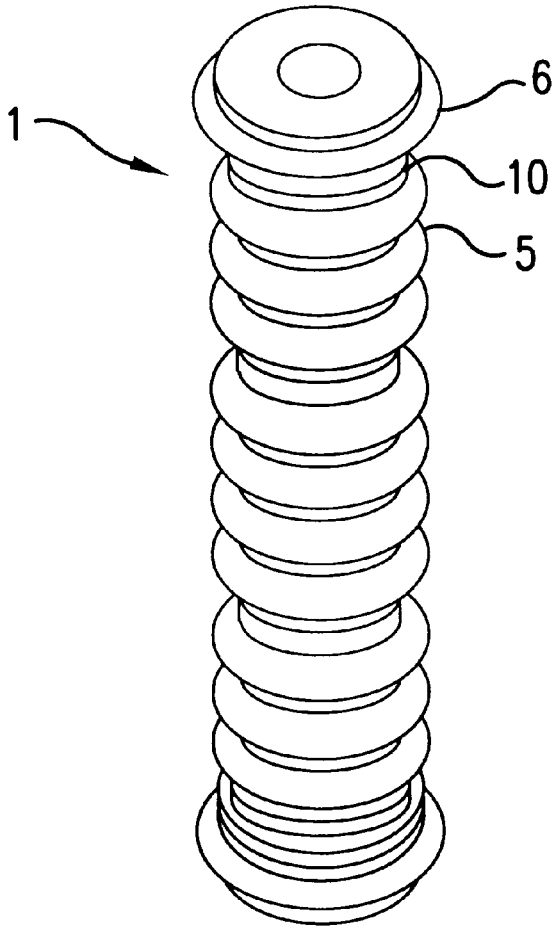
FIG. 1A is the perspective view of the plastic spring of the invention.
Figure 1B:
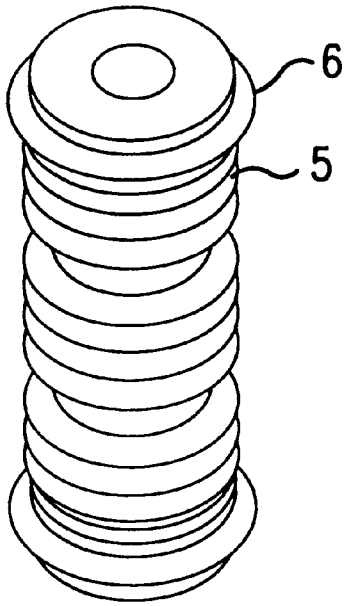
FIG. 1B shows the state of the plastic spring of FIG. 1A when being compressed by force exerted thereto.

A plastic spring 1 according to the present invention is shown. The plastic spring 1 is made by press forming a plastic sheet. The spring 1 comprises a plurality of protuberances 5, 6 and recesses 10. The spring 1 may be circular or polygonal in cross section. When force is applied to the spring 1, it will contract under compression (see FIG. 1B). Upon the removal of the force, the spring will return to its pre-compressed length which may be equal to or less than its original length, as discusses below.

Figure 2A:
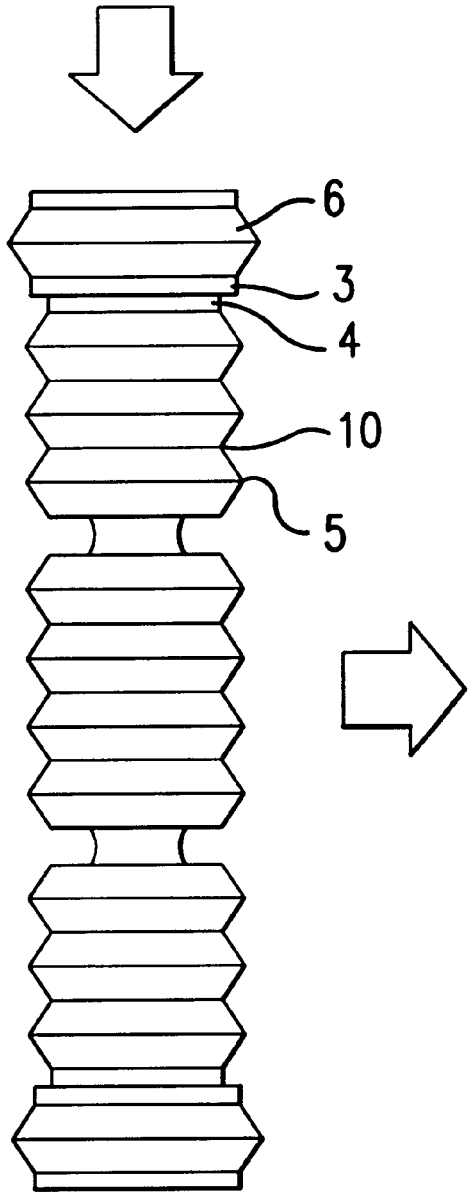
FIG. 2A is the side elevation view of the plastic spring of FIG. 1A.
Figure 2B:
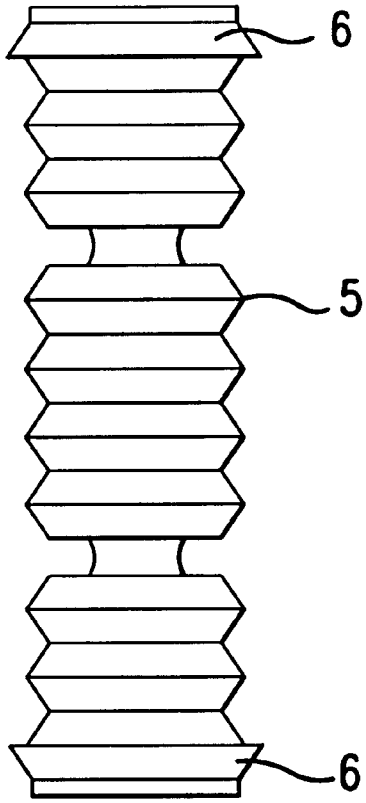
FIG. 2B shows the plastic spring of FIG. 2A when being compressed from both ends thereof.

According to a preferred embodiment of the spring of the invention, the width, also referred to as the diameter if the spring has a circular cross section, of the protuberance portions 6 at both ends of the spring is larger than that of the middle protuberance portions 5. A large step member 3 and a small step member 4 (see FIG. 2A) are both provided at the bottom of the upper protuberance 6 and the top of the lower protuberance 6, as shown in FIG. 2A. The large step member 3 has a width (diameter) which is smaller than that of its respective protuberance 6 and larger than that of its respective small step member 4. Therefore, when force is exerted against the spring 1, a lower half or an upper half portion of each respective protuberance 6 and the associated large step member 3 and small step member 4, at both ends of the spring, will enter into the other half portion of the protuberance 6, and then overlap on the neighboring protuberance 6 (see FIG. 2B). When the pressure is released, the protuberances 6 will not rebound. Instead, they will maintain the state shown in FIG. 2B and the spring 1 will move between this state and a compressed state when pressure is applied to the core. As a result, the stiffness of each spring at both ends thereof is enhanced, and the supporting capacity is more evenly distributed when compared to conventional pillows. Especially important is that, when the user's head moves on the pillow, unpleasant sounds will not be generated from inside the pillow.

Figure 3:
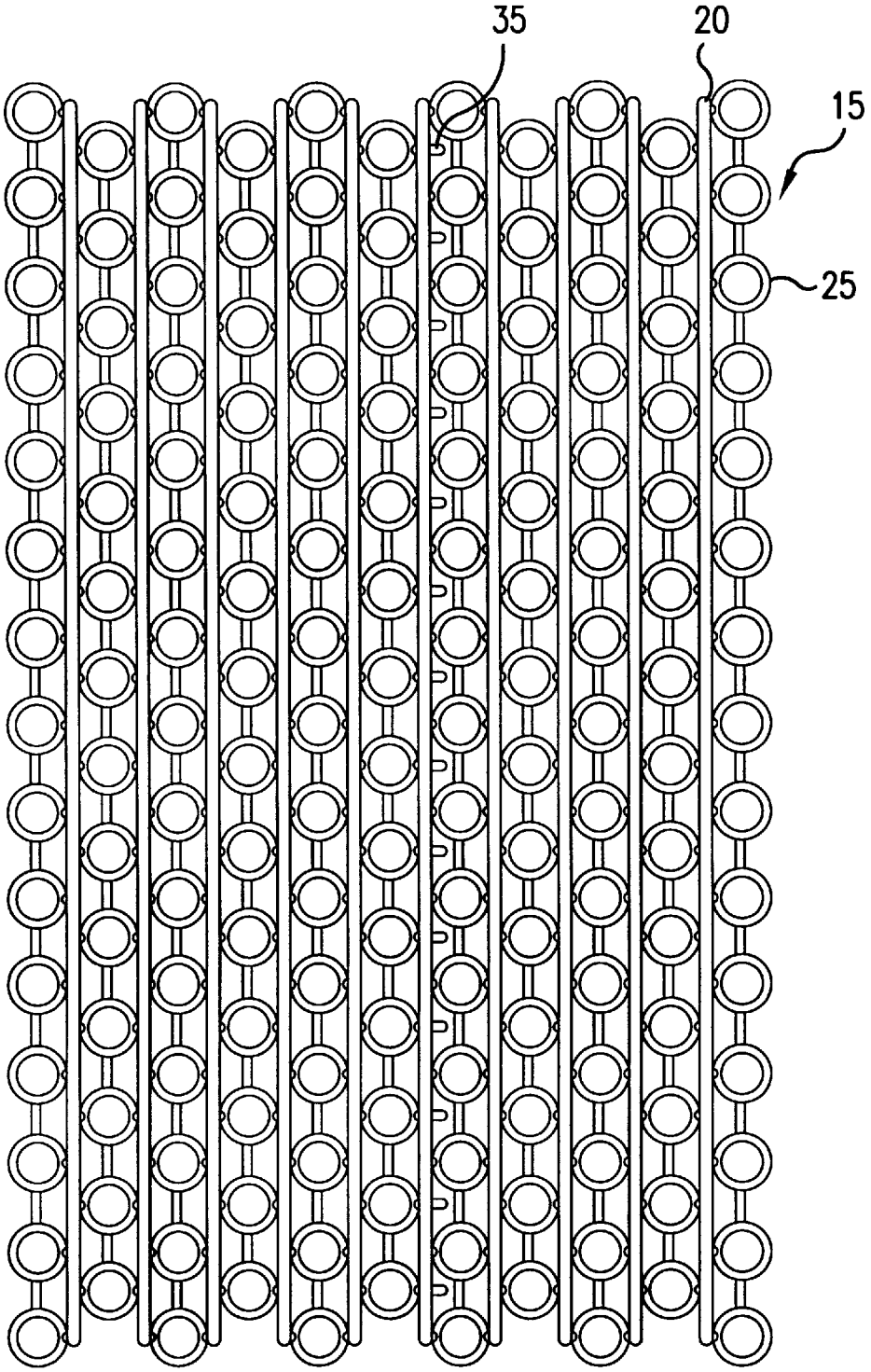
FIG. 3 schematically shows the plastic link frame for connecting the plastic springs according to the invention.
Figure 4:
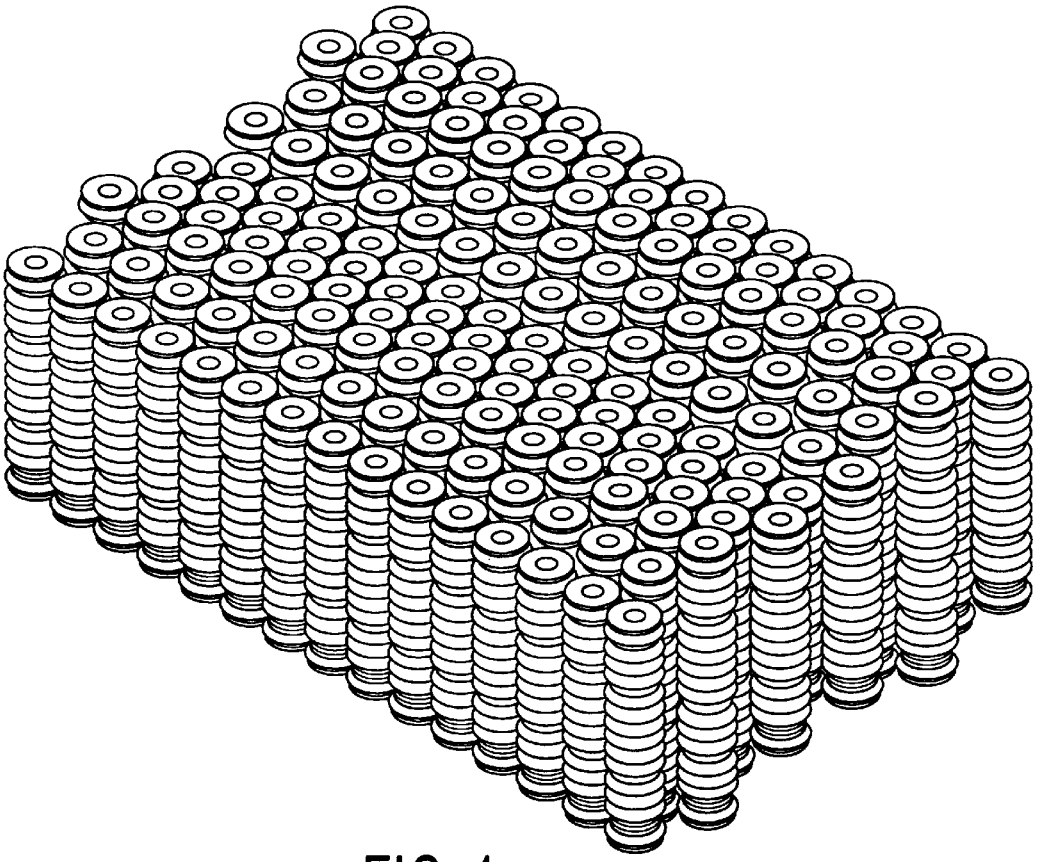
FIG. 4 is the view of the pillow core of a pillow size formed by a plurality of plastic springs connected by the plastic link frames as shown in FIG. 3.

Now, referring to FIG. 3, the plastic link frame 15 for connecting the plastic springs according to the present invention is shown. The link frame 15 includes cross bars 20 and a plurality of frame holes 25. When the plastic springs are inserted into the frame holes 25 and the frame holes 25 are locked exactly in their respective recesses 10, a pillow core as shown in FIG. 4 is formed.

Figure 5:
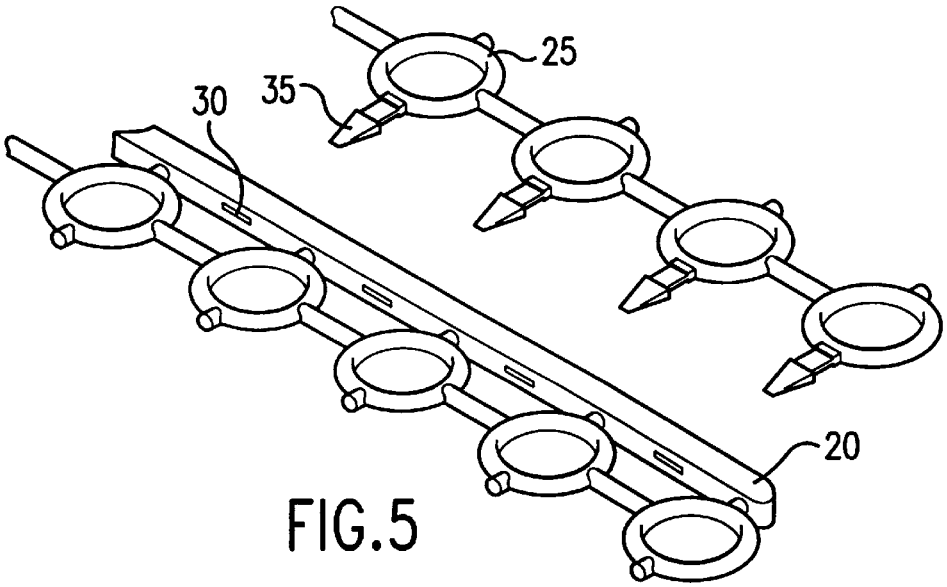
FIG. 5 schematically shows the interconnecting member of the plastic link frame of the pillow core according to the invention.

The plastic link frame can be tailored to meet the requirements of pillow cores having various sizes. For easy manufacture, the plastic link frame 15 may be made in a plug-socket form, as shown in FIG. 5. In this embodiment, a number of sockets 30 are formed along the cross bar 20 and pins 35 are formed on one side of the frame holes 25 so that two small-sized link frames can be assembled into a larger link frame by inserting the pins 35 into the sockets 30 on the cross bar 20. As a result, the size of the pillow core can be capriciously customized and the costs incurred from the press forming of the large-sized plastic link frame kept relatively low.

Figure 6:
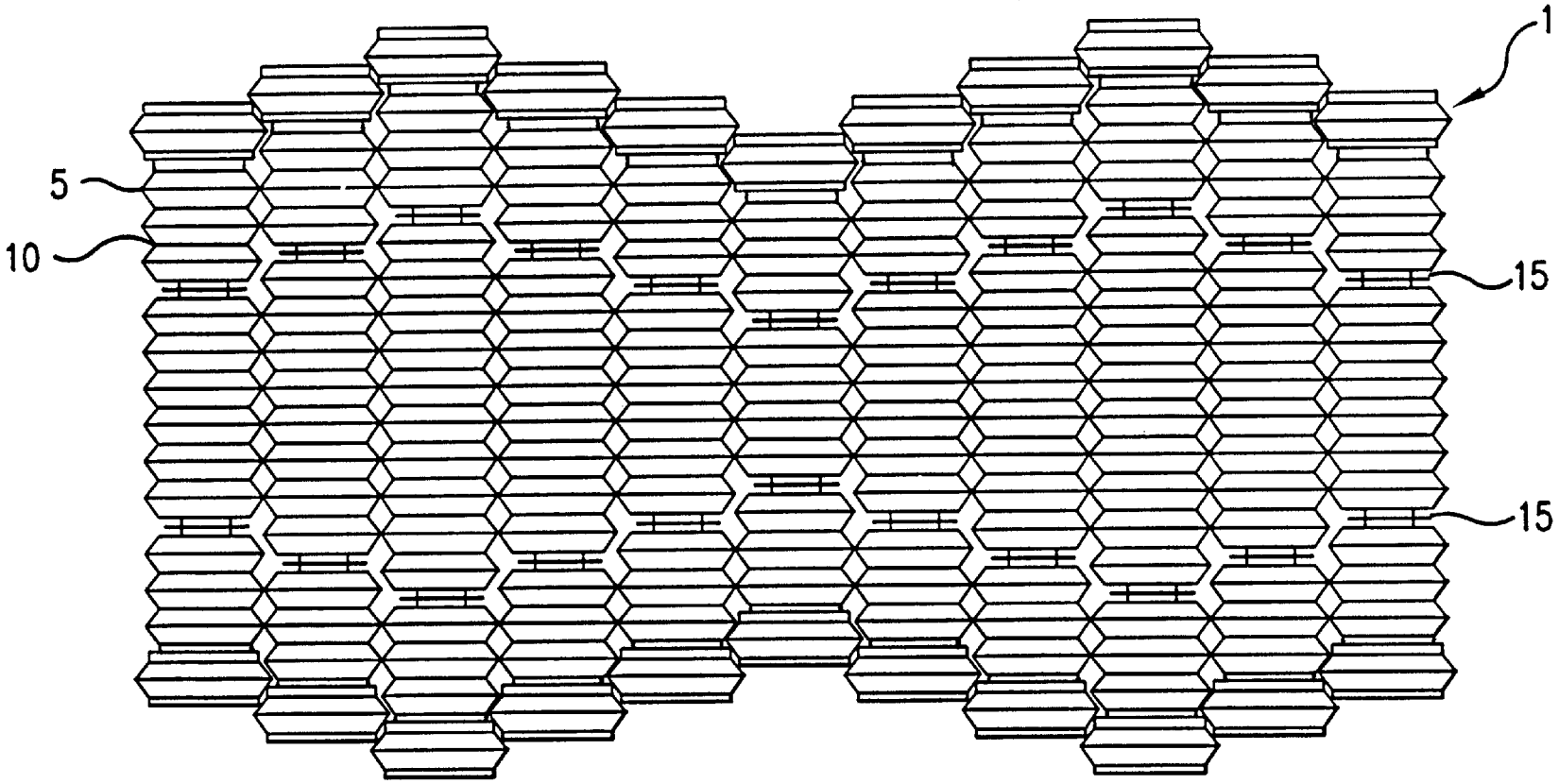
FIG. 6 is the side elevation view of the pillow core according to a further embodiment of the invention.
Figure 7:
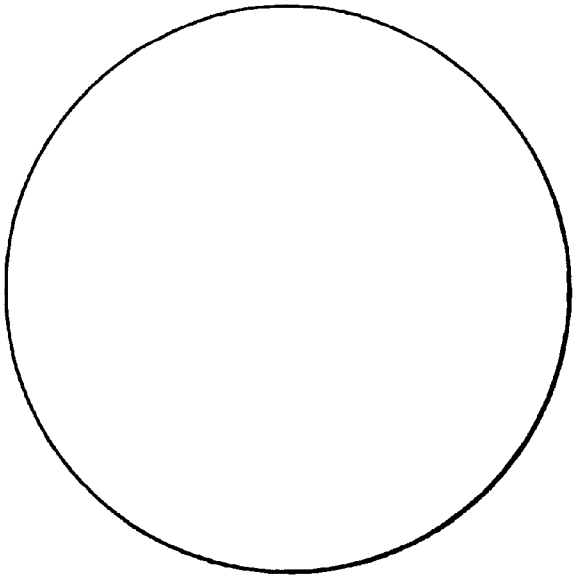
FIG. 7 is a cross section of a plastic spring according to the present invention.
Figure 8:
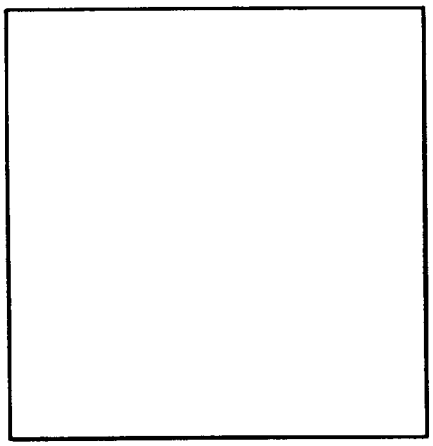
FIG. 8 is a cross section of a plastic spring according to another embodiment of the present invention.

In addition, as shown in FIG. 6, the height of the springs 1 may be selected so that the pillow core can be customized according to the neck profile and the individual preferences of the user.

To firmly fasten springs 1 into a pillow core, two or more link frames 15 spaced from each other along the length of the springs may be provided. These frames 15 secure adjacent springs 1 at their upper, lower or middle portions by positioning frame holes 25 around the springs 1 as discussed above. FIG. 6 shows an embodiment of the structure in which two-tier link frames 15 are used to connect the springs 1.

After the pillow core has been completely assembled, a pillow can be formed by placing the assembled pillow core into a pillow case.

What is claimed is:

1. A pillow core comprising:

a plurality of plastic springs, each spring comprising: a length extending between first and second ends; protuberances and recesses arranged along said length between said first and second ends, one of said protuberances being located at said first end and forming a first end protuberance, said first end protuberance having a width; first and second step members extending between said first end protuberance and an adjacent one of said protuberances along the length of said spring, the width of said first step member being less than that of said first end protuberance and the width of said second step member being less than that of said first step member, whereby when pressure is applied to one of said springs, an upper portion of said first end protuberance of said spring under pressure moves along the length of its respective spring and covers the respective first step member, the respective second step member and an upper portion of the respective adjacent protuberance to reduce the height of at least a portion of said pillow core; and a link frame including a plurality of cross bars and a plurality of spring receiving members for positioning about the exterior of a respective one of said recesses of said plastic springs.

2. The pillow core according to claim 1 wherein said first and second step members include outer sidewalls which extend parallel to the lengths of said springs.

3. The pillow core according to claim 1 wherein said protuberances have a round cross section, and each said width includes the diameter of said respective protuberance.

4. The pillow core according to claim 1 wherein one of said protuberances of each said spring is located at the second end thereof and forms a second end protuberance, and wherein each spring includes a third step member and a fourth step member which extend between the respective second end protuberance and an adjacent one of said protuberances.

5. The pillow core according to claim 4 wherein the widths of the end protuberances of each spring are greater than the widths of the respective protuberances located therebetween.

6. The pillow core according to claim 1 wherein said springs have a polygonal cross section.

7. The pillow core according to claim 1 wherein adjacent springs have a different height for accommodating a neck of a user.

8. The pillow core according to claim 1 wherein each spring receiving member includes a hole which is positioned in a respective one of said recesses along the length of a respective one of said springs.

9. The pillow core according to claim 8 wherein at least one said cross bars includes a plurality of sockets along its length, and a plurality of said spring receiving members each include an outwardly extending pin for positioning within a respective one of said sockets.

10. A pillow core comprising:

a plurality of plastic springs having first and second ends, each spring including a plurality of protuberances and recesses arranged along its length between said first and second ends; and a plastic link frame including a plurality of cross bars, each said cross bar including a plurality of spring receiving members, each spring receiving member having a hole and being positioned about a portion of a respective one of the springs and within one of said recesses along the length of the respective one of said springs.

11. The pillow core according to claim 10 wherein one of said protuberances is located at said first end and forms a first end protuberance, said first end protuberance having a width; first and second step members extending between said first end protuberance and an adjacent one of said protuberances along the length of said spring, said first step member having a width which is less than that of said first end protuberance and said second step member having a width which is less than that of said first step member, whereby when pressure is applied to one of said springs, an upper portion of said first end protuberance of said spring under pressure moves along the length of its respective spring and covers the respective first step member, the respective second step member and an upper portion of the respective adjacent protuberance to reduce the height of at least a portion of said pillow core.

12. The pillow core according to claim 11 wherein said first and second step members include outer sidewalls which extend parallel to the lengths of said springs.

13. The pillow core according to claim 10 wherein said protuberances have a round cross section.

14. The pillow core according to claim 11 wherein one of said protuberances of each said spring is located at the second end thereof and forms a second end protuberance, and wherein each spring includes a third step member and a fourth step member which extend between the respective second end protuberance and an adjacent one of said protuberances.

15. The pillow core according to claim 11 wherein adjacent springs have different heights for accommodating a neck of a user.

16. The pillow core according to claim 10 further including a second link frame, said link frames being spaced from each other along the lengths of said springs.

17. The pillow core according to claim 10 wherein at least one said cross bars includes a plurality of sockets along its length, and a plurality of said spring receiving members each include an outwardly extending pin for positioning within a respective one of said sockets.

* * * * *

UNITED STATES PATENT AND TRADEMARK OFFICE

CERTIFICATE OF CORRECTION

PATENT NO. : 6,101,651
DATED : August 15, 2000
INVENTOR(S) : Yee Keung Tang

It is certified that error appears in the above-identified patent and that said Letters Patent is hereby corrected as shown below:

Title page,
Between items [22] and [51], the following has been inserted:
-- Foreign Application Priority Data

[30] April 3, 1998 [CN] China.....98106211.3 --.

Signed and Sealed this

Ninth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,101,651
DATED : August 15, 2000
INVENTOR(S) : Yee Keung Tang

It is certified that error appears in the above-identified patent and that said Letters Patent is hereby corrected as shown below:

Title page,
Between items [22] and [51], the following has been inserted:
-- Foreign Application Priority Data

[30] April 3, 1998 [CN] China.....98106211.3 --.

Signed and Sealed this

Ninth Day of October, 2001

*Attest:*

Nicholas P. Godici

*Attesting Officer*

NICHOLAS P. GODICI
*Acting Director of the United States Patent and Trademark Office*